US007963221B2

(12) United States Patent
Patterson

(10) Patent No.: US 7,963,221 B2
(45) Date of Patent: Jun. 21, 2011

(54) SYSTEMS AND METHODS FOR FORMING CONTINUOUS INK IMAGES

(75) Inventor: Mark G. Patterson, Bellingham, WA (US)

(73) Assignee: Clearsnap Holding, Inc., Burlington, WA (US)

( * ) Notice: Subject to any disclaimer, the term of this patent is extended or adjusted under 35 U.S.C. 154(b) by 220 days.

(21) Appl. No.: 12/404,620

(22) Filed: Mar. 16, 2009

(65) Prior Publication Data

US 2009/0235834 A1 Sep. 24, 2009

Related U.S. Application Data

(60) Provisional application No. 61/070,203, filed on Mar. 19, 2008.

(51) Int. Cl.
*B41K 1/22* (2006.01)

(52) U.S. Cl. ..... 101/328; 101/327; 101/368; 101/375

(58) Field of Classification Search ..... 101/327, 101/333, 328, 329, 368, 375, 376
See application file for complete search history.

(56) References Cited

U.S. PATENT DOCUMENTS

| | | | |
|---|---|---|---|
| 209,763 | A | 11/1878 | Keeler |
| 321,223 | A | 6/1885 | Keeler |
| 427,229 | A | 5/1890 | French |
| 518,118 | A | 4/1894 | Rose |
| 642,367 | A | 1/1900 | Ray |
| 749,034 | A | 1/1904 | Daut |
| 829,230 | A | 8/1906 | Pope |
| 983,066 | A | 1/1911 | Kjeldaas |
| 1,070,763 | A | 8/1913 | Bauman |
| 1,127,806 | A | 2/1915 | Pells et al. |
| 1,291,057 | A | 1/1919 | Marks |
| 1,555,585 | A | 9/1925 | Kings et al. |
| 1,576,791 | A | 3/1926 | Rosner |
| 1,656,489 | A | 1/1928 | Low |
| 1,909,326 | A | 5/1933 | Wheeler, Jr. |
| 2,576,622 | A | 11/1951 | McBride |
| 2,784,668 | A | 3/1957 | Poje |
| 3,099,212 | A | 7/1963 | Sohn |

(Continued)

FOREIGN PATENT DOCUMENTS

| | | |
|---|---|---|
| DE | 231631 | 11/1909 |

(Continued)

OTHER PUBLICATIONS

European Patent Office, European Search Report, Jun. 24, 2009, 1 page.

*Primary Examiner* — Leslie J Evanisko
(74) *Attorney, Agent, or Firm* — Michael R. Schacht; Schacht Law Office, Inc.

(57) ABSTRACT

A wheel assembly for applying ink to a target surface comprises a wheel member defining a support portion, at least one adhesive sheet, and at least one inking member. The at least one adhesive sheet is detachably attached to the support portion of the wheel member. The at least one adhesive sheet defines an outer adhesive surface. The at least one inking member is detachably attached to the outer adhesive surface of the at least one adhesive sheet. When the at least one inking member detachably attached to the adhesive surface is brought into contact with the target surface, ink on the at least one inking member is transferred to the target surface.

13 Claims, 2 Drawing Sheets

U.S. PATENT DOCUMENTS

| | | | | |
|---|---|---|---|---|
| 3,167,009 | A | 1/1965 | Sloane | |
| 3,465,673 | A | 9/1969 | Oppenheim | |
| 3,537,394 | A | 11/1970 | Swapp | |
| 3,859,915 | A | 1/1975 | Hunter | |
| 4,181,560 | A | 1/1980 | Maitland | |
| 4,259,568 | A | 3/1981 | Dynesen | |
| 4,367,965 | A | 1/1983 | Speitel | |
| 4,593,618 | A | 6/1986 | Lebensfeld | |
| 4,727,616 | A | 3/1988 | Kucera et al. | |
| 4,817,526 | A | 4/1989 | Winston | |
| 5,027,465 | A | 7/1991 | McKay | |
| 5,303,648 | A | 4/1994 | Shih | |
| 5,410,962 | A | 5/1995 | Collier | |
| 5,435,245 | A | 7/1995 | Salisbury et al. | |
| 5,495,800 | A | 3/1996 | Weissbein et al. | |
| 5,505,133 | A | 4/1996 | Chen | |
| 5,732,627 | A | 3/1998 | Imamaki | |
| 5,735,208 | A | 4/1998 | Hummel et al. | |
| 5,924,157 | A | 7/1999 | Barela | |
| 6,234,078 | B1 | 5/2001 | Kessler | |
| 6,360,658 | B1 | 3/2002 | Benson | |
| 6,659,007 | B1 | 12/2003 | Winston | |
| 6,954,963 | B2 | 10/2005 | McKay | |
| 7,194,954 | B2 | 3/2007 | Winston | |
| 2007/0144366 | A1* | 6/2007 | Ogino | 101/109 |

FOREIGN PATENT DOCUMENTS

| | | |
|---|---|---|
| DE | 551219 | 5/1932 |
| DE | 551947 | 6/1932 |
| DE | 1259732 | 1/1968 |
| EP | 0442577 | 8/1991 |
| FR | 2294857 | 7/1976 |
| GB | 735761 | 8/1955 |
| GB | 1196169 | 6/1970 |
| IT | 451645 | 9/1949 |
| JP | 03254982 | 11/1991 |
| JP | 9277684 | 10/1997 |
| JP | 9309256 | 12/1997 |

* cited by examiner

SYSTEMS AND METHODS FOR FORMING CONTINUOUS INK IMAGES

RELATED APPLICATIONS

This application claims benefit of U.S. Provisional Patent Application Ser. No. 61/070,203 filed Mar. 19, 2008.

The subject matter of the foregoing related application is incorporated herein by reference.

FIELD OF THE INVENTION

The present invention relates to systems and methods for forming ink images and, more specifically, systems for facilitating the formation of continuous ink images.

BACKGROUND OF THE INVENTION

The present invention relates ink stamping systems and methods in which an ink impression is formed on an image surface. The ink is applied to a stamp member on which a design is formed in bas relief. The stamp member with ink thereon is brought into contact with the image surface such that ink is transferred to the image surface to form an ink impression or image in a configuration corresponding to the design on the stamp member.

The present invention is of particular importance in the formation of artistic rather than commercial ink impressions. Art stamping uses the same basic ink stamping process as commercial ink stamping but has evolved to allow more precise creative control over the details and quality of the resulting ink impression. The principles of the present invention may also have application to commercial ink stamping, however.

Ink stamping systems for use by art stampers are designed and constructed primarily to obtain a high quality ink impression, with flexibility of use also being of importance. Considerations such as repeatability of the ink impression, ease of use, and durability of the stamping devices are of lesser importance than in the commercial ink stamping environment.

In one conventional form, an inking assembly comprises a stamp member formed by flat sheet of rubber. A design formed in bas relief on a first surface of the stamp member. A stamp member is typically flexible, in which case a second surface of the stamp member is supported by a rigid member. The rigid member may comprise or be attached to a handle that facilitates manipulation of the stamp member.

Continuous inking assemblies that form a continuous, repeated ink image are also known. Such inking assemblies comprise a stamping wheel that supports a stamp member defining a cylindrical stamping surface. The design formed in bas relief on the stamp member is formed on the outer surface of the stamp member. The stamp member is mounted on a handle or handle assembly such that the handle can be grasped to roll the stamp member along an ink pad and then along an inking surface to form the desired ink impression on the inking surface. In some continuous inking assemblies, the ink pad is also mounted to the handle such that ink is continuously applied to the outer member of the stamp member as the stamp member rolls along the inking surface.

The need exists for improved systems and methods for creating continuous ink impressions utilizing continuous inking assemblies.

SUMMARY OF THE INVENTION

The present invention may be embodied as a wheel assembly for applying ink to a target surface comprising a wheel member defining a support portion, at least one adhesive sheet, and at least one inking member. The at least one adhesive sheet is detachably attached to the support portion of the wheel member and defines an outer adhesive surface. The at least one inking member is detachably attached to the outer adhesive surface of the at least one adhesive sheet. When the at least one inking member detachably attached to the adhesive surface is brought into contact with the target surface, ink on the at least one inking member is transferred to the target surface.

The present invention may also be embodied as a method of applying ink to a target surface comprising the following steps. A wheel member defining a support portion is provided. At least one adhesive sheet is detachably attached to the support portion of the wheel member such that the at least one adhesive sheet defines an outer adhesive surface. At least one inking member is detachably attached to the outer adhesive surface of the at least one adhesive sheet. The at least one inking member detachably attached to the adhesive surface is brought into contact with the target surface to transfer ink on the at least one inking member to the target surface.

The present invention may also be embodied as a wheel assembly for applying ink to a target surface comprising a wheel member defining a support portion, a plurality of adhesive sheets, and a plurality of inking members. The plurality of adhesive sheets is detachably attached to the support portion of the wheel member such that one of the plurality of adhesive sheets defines an outer adhesive surface. The plurality of inking members are detachably attached to the outer adhesive surface of one of the plurality of adhesive sheets. When the plurality of inking members detachably attached to the adhesive surface are brought into contact with the target surface, ink on the plurality of inking members is transferred to the target surface.

DETAILED DESCRIPTION OF THE PREFERRED EMBODIMENTS

Figure 1:
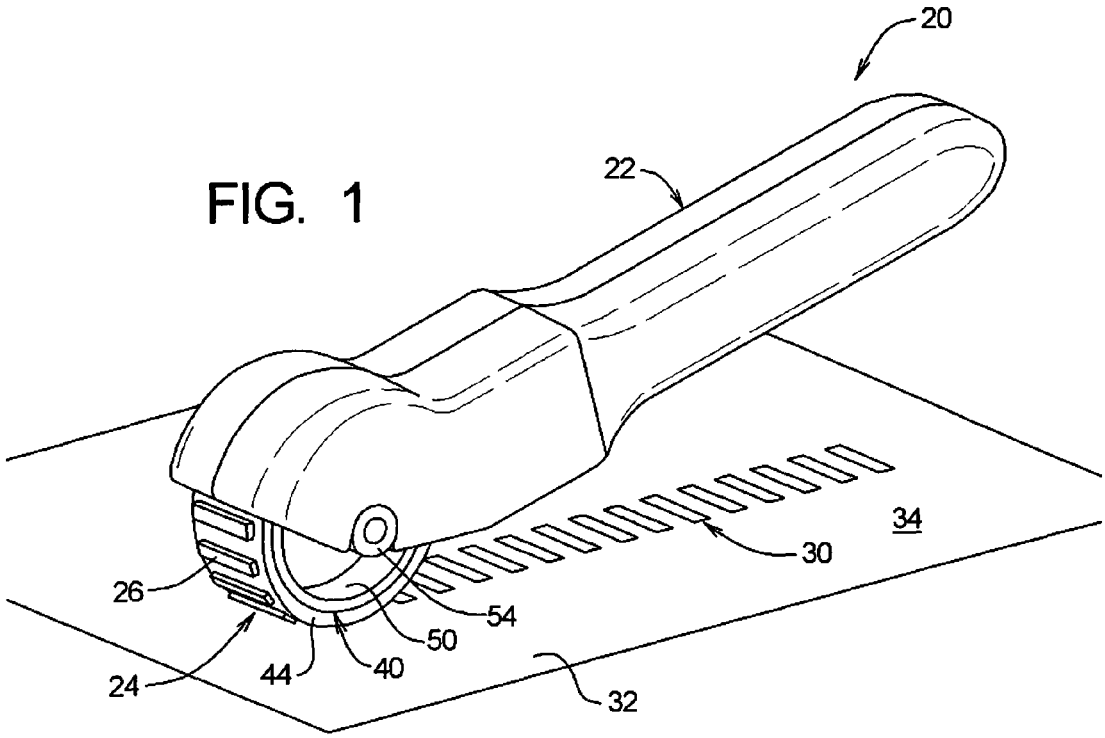
FIG. 1 is a perspective view illustrating the use of a continuous inking assembly constructed in accordance with, and embodying, the principles of the present invention.

Referring initially to FIG. 1, depicted at 20 therein is an inking system constructed in accordance with, and embodying, the principles of the present invention. The inking system 20 comprises a handle assembly 22 and a wheel assembly 24. The wheel assembly 24 defines an inking surface 26. The example inking system 20 is illustrated applying an ink image 30 to a target surface 32 of a target member 34. The example target member 34 is a sheet of paper, but the target surface 32 may be formed by target members other than a sheet of paper.

In use, ink is applied to the inking surface 26, and the inking surface 26 is brought into contact with the target surface 32. With the inking surface 26 is in contact with the target surface 32, the handle assembly 22 is displaced relative to the target member 34. The wheel assembly 24 rotates relative to the handle assembly 22 as the handle assembly 22 is displaced relative to the target member 34. As the inking system 20 is moves along the target surface 32, ink on the inking surface 26 is transferred to the target surface 32 to form the ink image 30.

Figure 2A:
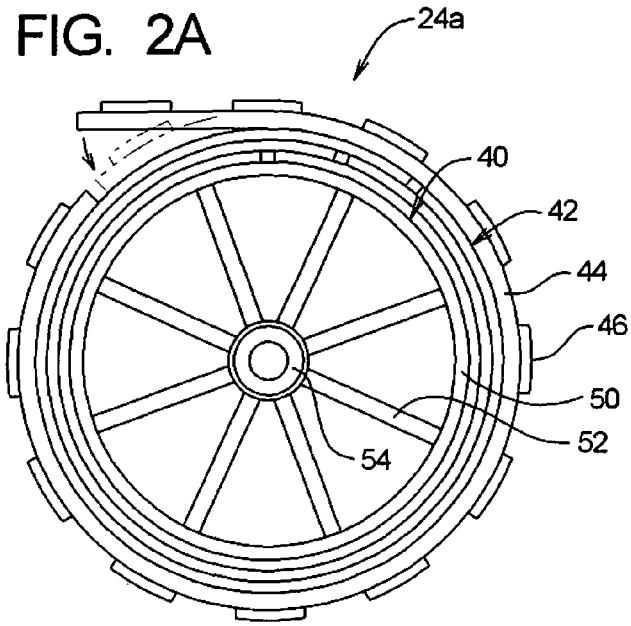
FIG. 2A is a side elevation view of a first example inking wheel assembly that may be used by the inking assembly of FIG. 1.

A first example wheel assembly 24*a* is depicted in FIG. 2 of the drawing. The first example wheel assembly 24*a* comprises a wheel member 40, at least one adhesive assembly 42, and at least one inking member 44 defining an inking surface 46. The wheel member 40 comprises a cylindrical support portion 50, at least one spoke portion 52, and an axle portion 54.

The first example wheel assembly 24*a* comprised three adhesive assemblies 42*a*, 42*b*, and 42*c*. The example adhesive assemblies 42 each comprise a sheet 60 of double stick tape and a sheet 62 of release material, as perhaps best shown in FIG. 2A. Each sheet 60 of double stick tape defines first and second adhesive surfaces 70 and 72. The release sheets 62 each define first and second non-adhesive surfaces 74 and 76.

The length of the tape sheet 60 is approximately equal to the circumference of the cylindrical support portion 50, and the width of the tape sheet 60 is approximately equal to the lateral dimensions of the support portion 50. The release sheets 62 are initially in contact with the second adhesive surfaces 72 of each of the sheets 60 of double stick tape.

The release sheets 62 are formulated such that the release sheets 62 may be detachably attached to the tape sheets 60. The release sheets 62 prevent the second adhesive surfaces 72 from inadvertently becoming bonded to another surface and protect the second adhesive surfaces 72 from becoming contaminated. However, the release sheets 62 may be detached from the tape sheets 60 to expose the first and second adhesive surfaces 70 and 72 as will be described in further detail below.

As initially configured, the example wheel assembly 24*a* comprises three of the adhesive assemblies 42, each one comprising a single tape sheet 60 and a single release sheet 62. The second non-adhesive surface 76 of the outermost release sheet 62 is thus exposed.

Figure 2B:
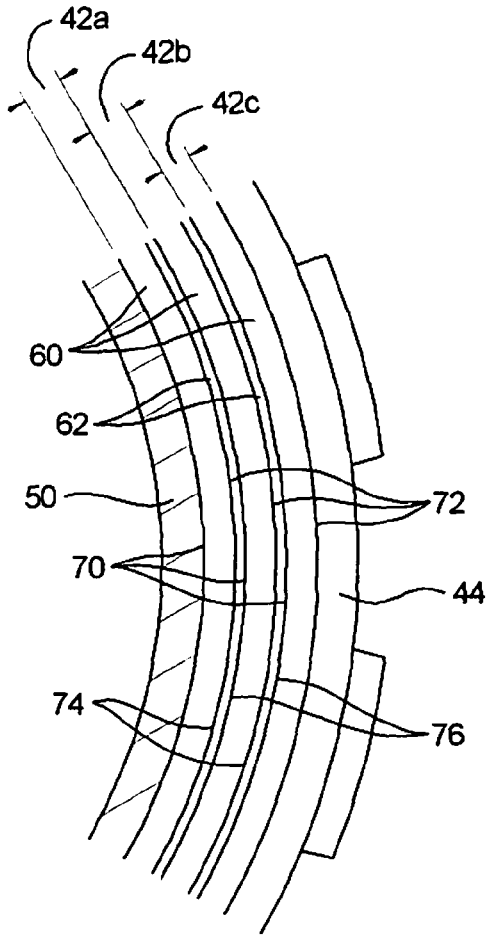
FIG. 2B is an enlarged view of a portion of the first example inking wheel.

In the example depicted in FIG. 2B, the release sheet 62 of the outermost adhesive assembly 42*c* has been removed, exposing the second adhesive surface 72 of the tape sheet 60 of the outermost adhesive assembly 42*c*. With the wheel assembly 24*a* removed from the handle member 22, the inking member 44 is brought into contact with the exposed second adhesive surface 72 of the outermost adhesive assembly 42*c* to detachably attach the inking member 44 to the wheel member 40 with the inking surface 46 exposed. The wheel assembly 24*a* is then detachably attached to the handle assembly 22. Ink is applied to the inking surface 46, and the inking system 20 may then be used in a conventional manner to form the ink image 30 on the target surface 32.

If a different ink image is desired, the inking member 44 may be removed, and another inking member may be detachably attached to the wheel member 40 using one or more of the layered adhesive assemblies 42. The inking system 20 may be used to form a different ink image with the different inking member attached thereto.

The tape sheet 60 defining the second adhesive surface 72 of the outermost adhesive assembly 42*c* can be use once and discarded, but more likely the tape sheet 60 will be used multiple times. Eventually, however, the adhesive properties of the second adhesive surface 72 of the outermost adhesive assembly 42*c* will diminish.

At this point, the tape sheet 60 of the outermost adhesive assembly 42*c* can be removed, exposing the release sheet 62 of the intermediate adhesive assembly 42*a*. The release sheet 62 of the intermediate adhesive assembly 42*b* can then be removed, exposing the second adhesive surface 72 of the tape sheet 60 of the intermediate adhesive assembly 42*b*. The tape sheet 60 of the intermediate adhesive assembly 42*b* may then be used to attach one or more inking member to the wheel member 40 as described above.

When the adhesive properties of the tape sheet 60 of the intermediate adhesive assembly 42*b* become diminished, the tape sheet 60 of the intermediate adhesive assembly 42*b* can be removed, exposing the release sheet 62 of the innermost adhesive assembly 42*a*. The release sheet 62 of the innermost adhesive assembly 42*a* can then be removed, exposing the second adhesive surface 72 of the tape sheet 60 of the innermost adhesive assembly 42*a*. The tape sheet 60 of the innermost adhesive assembly 42*a* may then be used to attach one or more inking members to the wheel member 40 as described above.

The example inking system 20, and in particular the wheel assembly 24 thereof, can thus be used and reused in a highly flexible manner that allows an art stamper to form custom continuous ink images.

Figure 3:
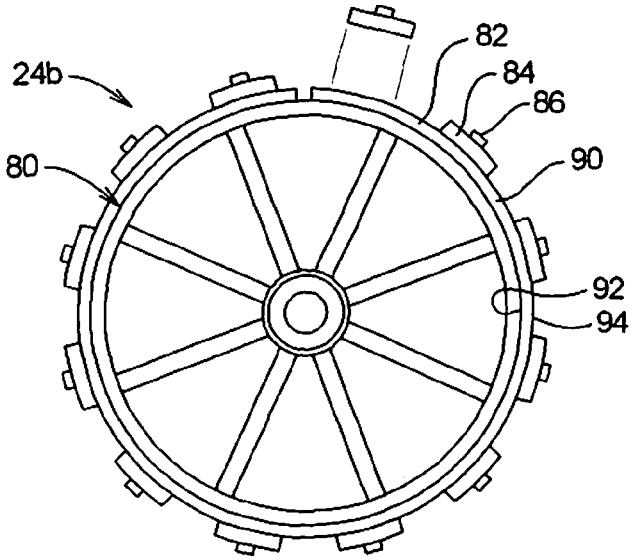
FIG. 3 is a side elevation view of a second example inking wheel assembly that may be used by the inking assembly of FIG. 1.

Turning now to FIG. 3 of the drawing, depicted therein is a second example wheel assembly 24*b*. Like the wheel assembly 24*a* described above, the wheel assembly 24*b* comprises a wheel member 80, at least one adhesive assembly 82, and a plurality (two or more) of inking members 84 each defining an inking surface 86. The wheel member 80 and adhesive assembly 82 may be the same as the wheel member 40 and adhesive assemblies 42 described above and will not be described in further detail herein.

The example wheel assembly 24*b* may, like the first example wheel assembly 24*a*, originally comprise a plurality of the adhesive assemblies, each originally also comprising a sheet of release material. At the stage of use depicted in FIG. 3, however, the second example wheel assembly 24*b* comprises only a single adhesive assembly 82, with only a sheet 90 of double-stick tape of that adhesive assembly 82 remaining. Either only one such adhesive assembly 82 may be been originally provided, or additional adhesive assemblies may have been removed.

FIG. 3 illustrates that the tape sheet 90 defines first and second adhesive surfaces 92 and 94. The first adhesive surface 92 is adhered to the wheel member 80, and the second adhesive surface 94 is exposed. In the example wheel assembly 24*b*, the plurality of inking members 84 are individually adhered at desired locations on the exposed second adhesive surface 94 of the tape sheet 90. So adhered, the inking surfaces 86 are extend outwardly from the wheel assembly 24*b*. The user can thus detachably attach the inking members 84 to different locations on the exposed adhesive surface 94 to create a desired arrangement of the inking surfaces 86 about the circumference of the wheel assembly 24*b*.

When the wheel assembly 24*b* is attached to the handle assembly 22 and ink is applied to the inking surfaces 86 of the desired arrangement of inking members 84, the inking system 20 may be used in a generally conventional manner to form an ink image corresponding to the desired arrangement of inking surfaces 86.

The handle assembly 22 is or may be conventional. Examples of handle assemblies appropriate for use as the example handle assembly 22 are described in U.S. Pat. Nos. 6,659,007 and 7,194,954, the contents of which are incorporated herein by reference.

In the specific example embodiments described above, the example adhesive assemblies are substantially planar and have two exposed surfaces and two edges. The example adhesive assemblies described above comprise an adhesive sheet both exposed surfaces of which are adhesive; in this case, release sheets are arranged between each pair of release sheets. The release sheets allow the adhesive sheets to adhere to each other to prevent inadvertent removal of an outer adhesive sheet from an inner adhesive sheet adjacent thereto but allow the outer adhesive sheet to be removed by deliberate application of manual force.

Alternatively, only the external exposed surfaces of the adhesive sheets may be made adhesive; in this case, the internal exposed surfaces are formed of a material that adheres to the adhesive, external exposed surfaces sufficiently to prevent inadvertent removal of an outer adhesive sheet from an inner adhesive sheet adjacent thereto but releases to allow the outer adhesive sheet to be removed from an inner adhesive sheet by deliberate application of manual force. In this case, a separate release sheet may be provided for the outermost adhesive sheet to prevent contamination of the adhesive, external exposed surface of the outermost adhesive sheet during manufacture, shipping, and retail display.

Additionally, instead of a plurality of separate adhesive sheets, a single, continuous adhesive sheet may be wound in a helical shape to form several layers around the wheel member. In this case, the adhesive sheet may be double stick tape with a release sheet or have one adhesive surface and one release surface. In either situation, the adhesive sheet must be cut or torn to expose a new, uncontaminated adhesive outer surface when desired. To facilitate tearing of the adhesive sheet, score lines or perforations may be formed at intervals along the length of the adhesive layer.

In any situation where separate sheets or a single adhesive sheet with score lines or perforations are used, the sheets, score lines, or perforations may be angled with respect to the wheel axis. Angling of the edges of the sheets prevents gaps that might interfere with adherence of items to the exposed adhesive surface of the outermost adhesive sheet.

While the inking members described above may be formed of conventional ink stamps, the inking members may be formed of items not specifically manufactured to carry and apply ink. For example, materials such as sand, leather, seashells, glass, or the like may be applied to the exposed adhesive surface of the outermost adhesive sheet to provide a texture look to the applied ink. In this case, at least some of the material carried on the exposed adhesive surface may be transferred to the surface to be inked to enhance the physical texture and/or look of the image formed on the surface to be inked.

From the foregoing, it should be apparent that the present invention may be embodied in many different combinations and sub-combinations of the elements and steps described above. The scope of the present invention should thus be determined by the claims to be appended hereto and not the foregoing detailed description.

What is claimed is:

1. A wheel assembly for applying ink to a target surface, comprising:

a wheel member defining a support portion;

at least one adhesive sheet detachably attached to the support portion of the wheel member, where the at least one adhesive sheet defines an outer adhesive surface, the at least one adhesive sheet comprises a first adhesive sheet and a second adhesive sheet, the first adhesive sheet is attached to the support portion of the wheel member, and the second adhesive sheet is detachably attached to the first adhesive sheet such that the second adhesive sheet defines the outer adhesive surface; and at least one inking member detachably attached to the outer adhesive surface of the at least one adhesive sheet; wherein when the at least one inking member detachably attached to the adhesive surface is brought into contact with the target surface, ink on the at least one inking member is transferred to the target surface.

2. A wheel assembly as recited in claim 1, in which:

the at least one adhesive sheet further comprises a third adhesive sheet; and the third adhesive sheet is detachably attached to the second adhesive sheet such that the third adhesive sheet defines the outer adhesive surface.

3. A wheel assembly as recited in claim 1, further comprising a release sheet that is detachably attached to the outer adhesive surface, where the release sheet is detached from the outer adhesive surface to expose the outer adhesive surface.

4. A wheel assembly as recited in claim 1, further comprising a plurality of release sheets, wherein:

each adhesive sheet defines a plurality of adhesive surfaces; and each release sheet is detachably attached to one of the adhesive surfaces of an associated adhesive sheet.

5. A wheel assembly as recited in claim 4, in which:

each adhesive sheet defines an inner adhesive surface and an outer adhesive surface; and each release sheet is attached to the outer adhesive surface of the associated adhesive sheet.

6. A wheel assembly as recited in claim 1, in which a plurality of inking members are detachably attached to the outer adhesive surface.

7. A method of applying ink to a target surface, comprising the steps of:

providing a wheel member defining a support portion;

detachably attaching at least one adhesive sheet to the support portion of the wheel member such that the at least one adhesive sheet defines an outer adhesive surface;

forming a plurality of adhesive surfaces on each adhesive sheet;

providing a plurality of release sheets;

detachably attaching one of the plurality of release sheets to an outer adhesive surface of each of the adhesive sheets;

detachably attaching one of the plurality of release sheets to an inner adhesive surface of an adjacent adhesive sheet;

detachably attaching at least one inking member to the outer adhesive surface of the at least one adhesive sheet; and bringing the at least one inking member detachably attached to the adhesive surface into contact with the target surface to transfer ink on the at least one inking member to the target surface.

8. An inking method as recited in claim 7, in which the step of detachably attaching at least one inking member to the outer adhesive surface comprises the steps of detachably attaching a plurality of inking members to the outer adhesive surface.

9. A wheel assembly for applying ink to a target surface, comprising:

a wheel member defining a support portion;

a plurality of adhesive sheets detachably attached to the support portion of the wheel member, where one of the plurality of adhesive sheets defines an outer adhesive surface; and a plurality of inking members detachably attached to the outer adhesive surface of one of the plurality of adhesive sheets; wherein when the plurality of inking members detachably attached to the adhesive surface are brought into contact with the target surface, ink on the plurality of inking members is transferred to the target surface.

10. A wheel assembly as recited in claim 9, further comprising a release sheet that is detachably attached to the outer adhesive surface, where the release sheet is detached from the outer adhesive surface to expose the outer adhesive surface.

11. A wheel assembly as recited in claim 9, further comprising a plurality of release sheets, wherein:

each adhesive sheet defines a plurality of adhesive surfaces; and each release sheet is detachably attached to one of the adhesive surfaces of an associated adhesive sheet.

12. A wheel assembly as recited in claim 11, in which:

each adhesive sheet defines an inner adhesive surface and an outer adhesive surface; and each release sheet is attached to the outer adhesive surface of the associated adhesive sheet.

13. A wheel assembly as recited in claim 11, in which:

each adhesive sheet defines an inner adhesive surface and an outer adhesive surface;

each release sheet is attached to the outer adhesive surface of the associated adhesive sheet; and at least one release sheet is also attached to the inner adhesive surface of an adhesive sheet adjacent to the associated adhesive sheet.

* * * * *